United States Patent [19]

Frohbieter

[11] 4,158,426

[45] Jun. 19, 1979

[54] DISPENSING SYSTEM AND METHOD FOR DISPENSING DISCRETE ELEMENTS

[75] Inventor: Edwin H. Frohbieter, Stevensville, Mich.

[73] Assignee: Whirlpool Corporation, Benton Harbor, Mich.

[21] Appl. No.: 789,733

[22] Filed: Apr. 21, 1977

[51] Int. Cl.[2] ..... G01F 11/24

[52] U.S. Cl. ..... 222/1; 222/240; 366/186

[58] Field of Search ..... 222/1, 225, 239–242, 222/370; 221/80, 261, 203, 235, 265, 237, 107, 169; 366/186, 190, 196

[56] References Cited

U.S. PATENT DOCUMENTS

| | | | |
|---|---|---|---|
| 817,727 | 4/1906 | Sletto | 222/239 X |
| 972,205 | 10/1910 | May | 222/225 |
| 2,102,948 | 12/1937 | Francis | 222/239 X |
| 2,408,775 | 10/1946 | Greenwood | 222/240 |
| 2,685,988 | 8/1954 | Nelson | 222/370 |
| 2,880,906 | 4/1959 | Probasco | 221/265 X |
| 3,101,872 | 8/1963 | Dickinson | 222/370 X |
| 3,877,241 | 4/1975 | Wade | 302/2 R X |

*Primary Examiner*—Stanley H. Tollberg

*Assistant Examiner*—Fred A. Silverberg

*Attorney, Agent, or Firm*—Wegner, Stellman, McCord, Wiles & Wood

[57] ABSTRACT

A dispensing apparatus for dispensing discrete elements from a container defining a storage space containing the elements into a transport apparatus for transporting the elements to a discharge location. The dispensing apparatus defines a recess opening generally horizontally to the storage space at a lower portion thereof. The elements are guided into the recess which preferably has a height substantially equal to the greatest transverse dimension of the elements. A transferring structure is provided to be disposable selectively subjacent the recess for receiving the elements from the recess and transferring the received elements to a discharge position. In one embodiment, the apparatus dispenses ice bodies into an air-operated transport system. An agitator for agitating the elements in the storage space may be utilized to effect the desired guiding of the elements into the recess. The recess may be defined by a shelf projecting under the main body of elements in the storage space whereby only a small number of the elements are received in the recess free of downward pressure from the elements in the upper portion of the storage space.

20 Claims, 6 Drawing Figures

35
24
4
28
25
53
54
55
32
4
55
24
22
54
29
53
17
37
18
56
42
19
38
21
30
43
23
22
5
5
39
46
3
49
3
40
22
55
48
41
24
25
33
35
27
28
26
34
29
36
15
32
31

DISPENSING SYSTEM AND METHOD FOR DISPENSING DISCRETE ELEMENTS

BACKGROUND OF THE INVENTION

1. Field of the Invention

This invention relates to dispensing apparatus and in particular to apparatus for dispensing seriatim preselected small numbers of discrete elements from a relatively large storage space.

2. Description of the Prior Art

In U.S. Pat. No. 3,877,241 of Charles H. Wade, which patent is owned by the assignee hereof, an air transport system for use in transporting ice from an ice maker to any one of a plurality of ice storage bins is shown to include means for flowing a body of air through a distribution system to carry with it ice bodies delivered into the air stream from the ice maker. The present invention is concerned with the means for injecting the ice bodies into the air stream effectively as individual ice body elements and, thus, is concerned with eliminating the problem of clumping or crushing of ice bodies which may occur in conventional injector valves of the prior art.

A number of different devices have been developed over the years for dispensing discrete elements from a larger mass. Illustratively, Robert B. May, in U.S. Pat. No. 972,205, shows a peanut planter wherein a disk is provided with suitable openings and mounted for rotation to carry peanuts delivered into the openings in a dispensing operation. As the openings pass under an apron of a hood portion of the device, surplus nuts are swept away from those which are located or carried directly by the opening 11. Thus, any peanuts which would project upwardly from the opening would either be swept away or sheared off in the operation of the planter.

Ralph L. Ford shows, in U.S. Pat. No. 1,062,449, a dropping device for corn planters having a seed plate and an agitating plate which are rotatable. The seed is distributed on the seed plate and in the recesses thereof so that the seed in the recesses is carried underneath the bridge of the device and ejected through the recesses when the recesses are aligned with the ejector portion of the device. A spring-loaded finger is provided for facilitating discharge of the corn from the recesses. A bridge device is provided which may shear the corn projecting upwardly from the recesses.

In U.S. Pat. No. 1,172,603, Nelson P. Johnson shows a measuring and dispensing device for granulated soap. The device includes an agitator at the lower portion of the hopper and is provided with a disklike rotor having cavities spaced circumferentially about its periphery for delivering the particular soap from the hopper to a discharge zone. A spring finger is provided for urging the soap from the cavities of the rotor at the discharge position. The soap in the cavities is exposed to the soap in the hopper above the cavities as the rotor is rotated to bring the respective recesses thereof to the discharge zone.

In U.S. Pat. No. 1,901,203, G. S. Thompson shows a coal feeder wherein finely divided coal is loosened by agitators to fall into slots of a feed disk. The feed disk is rotated to carry the coal in the slots thereof in measured quantities into a discharge compartment. Thompson teaches that surplus coal is scraped off the surface of the disk by the edge of a partition during operation of the device.

Charles H. White, in U.S. Pat. No. 2,297,642, shows a peanut planter wherein sprial shaped ridges on the seed plate force the peanuts radially outwardly towards the seed cells at the periphery of the plate. Scalloped edges on the bottom ring of the device exert an action on the peanuts tending to prevent bridging and to turn the peanuts so that they drop lengthwise into the seed cells.

William A. Eschenburg et al, in U.S. Pat. No. 2,969,650, show an ice making and vending machine utilizing an auger-type agitator for preventing coherence or fusing between contacting ice bodies.

In U.S. Pat. No. 3,075,363 of Armando F. Conto, an ice dispensing attachment for beverage dispensing machines is shown for dispensing chipped ice from the bottom of a hopper. A wiper plate is provided for cooperation with an upper edge of a duct to level off the ice within the transport chamber so that when the chamber is disposed in overlying relationship to the discharge opening, a measured quantity of ice substantially equal to the volume of the chamber will drop downwardly into the discharge duct.

Donald L. Dickinson, in U.S. Pat. No. 3,101,872, shows an ice storing and dispensing mechanism which is similar to Conto in providing scraped or crushed ice and provides an ice scraper which is secured to the inner wall of the ice hopper for cutting and channeling the crushed or chipped ice radially inwardly from the hopper wall.

Paul F. Burton et al, in U.S. Pat. No. 3,144,965, show an ice storage and dispensing hopper having a rotatable plate at the bottom thereof provided with a removable cup. The rotatable plate is disposed subjacent a stationary plate so that ice from the hopper may drop into and fill the cup carried by the rotatable plate. Rotation of the rotatable plate then carries the measuring cup under the stationary plate which shears off any portion of the ice extending upwardly from the cup so that only the measured charge of ice to be dispensed is delivered by the cup under the overlying stationary plate.

SUMMARY OF THE INVENTION

The present invention, as indicated briefly above, comprehends an improved injector valve for dispensing discrete elements, such as ice bodies, to a discharge position, such as the duct of an air transport system.

As the ice bodies effectively comprise elements tending to fuse together or clump when urged forcibly together, the present invention provides an improved functioning structure in connection with such injector valves by effectively precluding such clumping, and more specifically, precluding such clumping which may be induced by the weight of the ice bodies in the storage hopper.

While it is conventional to provide some form of agitating means in the bottom of such storage hoppers to break up the clumping of the elements therein, a problem arises in the maintaining of the elements effectively in unclumped condition when they are urged into the transferring recesses of the dispensing device. At such time, the weight of the elements in the storage hopper may again cause the elements to clump so that when the elements are brought to the discharge zone, a shearing action may occur by engagement of the overlying wall conventionally provided thereat so that undersirable breakup or crushing of the elements results. Where the elements comprise ice bodies, the shearing action causes slush and water to form, thereby presenting a highly undesirable condition in the transport system.

In certain applications, such as ice dispensing for use in beverages, it is highly desirable to provide ice cubes of nearly uniform size whose integrity has not been impaired by the dispensing process. The present invention overcomes the problems of the prior art wherein ice cubes were often crushed or sheared by the dispenser.

The present invention solves this vexatious problem by preventing the overburden-induced clumping of such elements when they are transferred to the measuring recesses. The invention comprehends providing a shelf over the path of movement of the recesses so that when the elements, such as ice bodies, are delivered into the recesses, effectively all downward pressure from the overburden ice bodies in the hopper is prevented from acting on the ice bodies in the recess thereby maintaining the ice bodies free for facilitated discharge at the discharge zone without the need for shearing off upper portions of the ice bodies.

To further assure such desirable operation, the shelf is arranged to permit only a single level of ice bodies to pass thereunder, thereby effectively minimizing the height of the ice bodies in the transfer recesses.

The agitator may comprise the means for effecting the delivery of the ice bodies from the lower portion of the hopper laterally to the transfer recesses. Thus, the agitator may provide a tumbling action to the ice bodies in the hopper tending to urge the lower strata of ice bodies laterally outwardly toward the central recess means under the above discussed shelf structure.

In the illustrated embodiment, the transfer recesses are defined by a peripheral portion of a transfer rotor having a height generally similar to the height of the ice bodies being transferred, and the shelf is spaced above the rotor a generally similar distance so that effectively only a single ice body is superposed on the ice body in the recess, thereby effectively precluding clumping of the ice bodies in the transfer operation.

Adjacent the discharge zone, a cover member is provided for returning ice bodies above the level of the rotor back into the lower portion of the hopper so that when the rotor recess reaches the discharge zone, only a single layer of ice bodies is disposed in the recess to be dispensed into the air transport system one at a time.

Thus, the injection apparatus of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
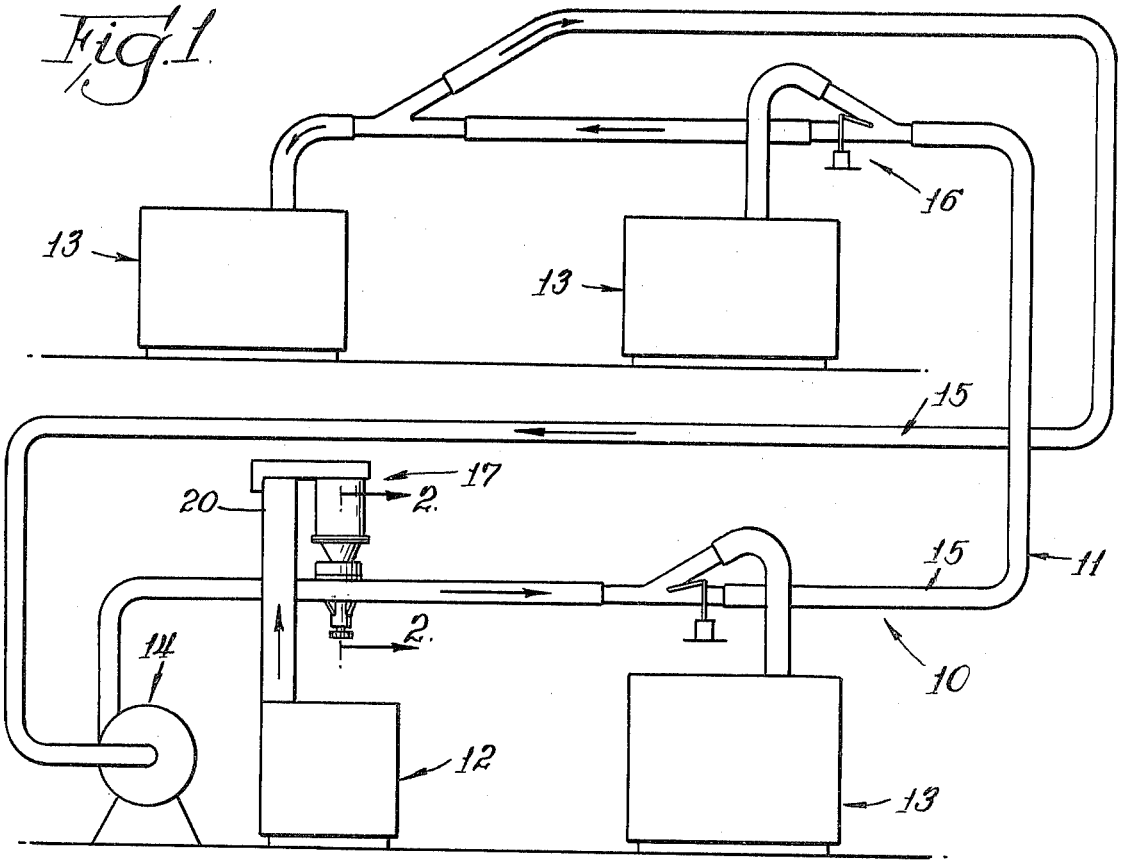
FIG. 1 is a schematic view of an ice making and transporting system having a dispensing apparatus embodying the invention.

In the exemplary embodiment of the invention as disclosed in the drawing, a dispensing apparatus generally designated 10 is shown to include an air transport system generally designated 11 for delivering a plurality of discrete elements, such as ice bodies 56, which in the illustrated embodiment comprise ice cubes, from an ice maker generally designated 12 to a plurality of storage bins generally designated 13.

The transport system illustratively utilizes flowing air as the transport medium and includes a suitable blower generally designated 14 for providing a circulation of the transport air through a circulatory duct arrangement 15 of the ice transport system.

As shown in FIG. 1, ice bodies being transported through the transport system 11 are delivered to the respective distribution bins 13 selectively by means of suitable distribution valves 16. One improved form of such a distribution valve is shown in U.S. Pat. No. 3,877,241, of Charles H. Wade, owned by the assignee hereof, as discussed briefly above. The present invention is concerned with the provision of an improved injector valve generally designated 17 for injecting the ice bodies into the air transport system from the ice maker 12.

Figures 2, 3, 4:
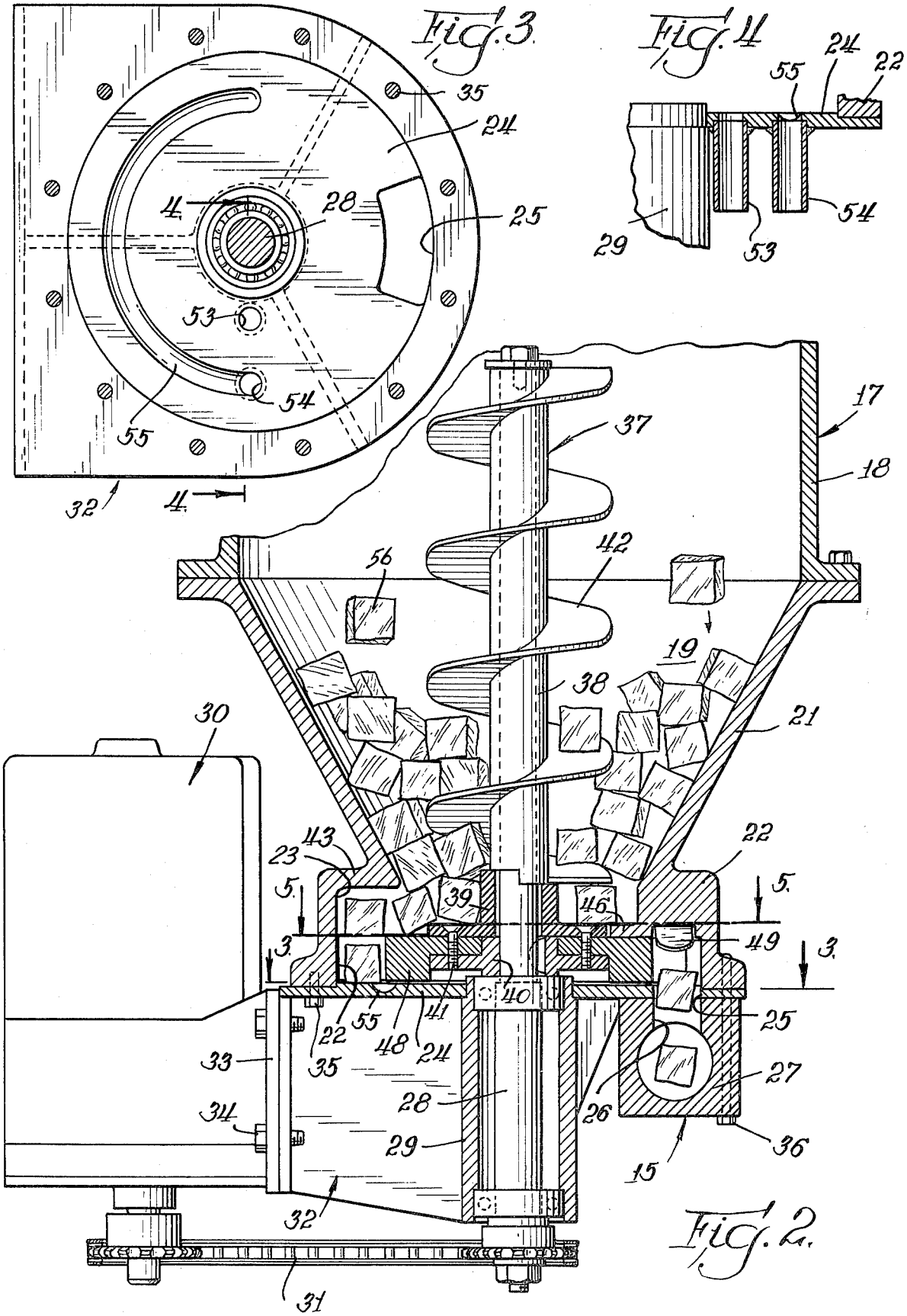
FIG. 2 is a fragmentary enlarged vertical section of the dispensing apparatus.
FIG. 3 is a fragmentary horizontal section taken substantially along the line 3—3 of FIG. 2.
FIG. 4 is a fragmentary vertical section taken substantially along the line 4—4 of FIG. 3.

As best seen in FIGS. 1 and 2, the injector valve comprises an improved dispensing apparatus for delivering the ice bodies effectively one at a time into the flowing air in the duct portion 15 of the ice transport system. The injector valve dispensing means includes an upper hopper 18 defining a storage space 19 in which ice bodies are collected from the ice maker 12. The ice bodies may be delivered to the hopper by means of a suitable conveyor 20 so as to provide a substantial quantity of ice bodies at all times in the storage space 19 of the hopper.

As best seen in FIG. 2, the hopper 18 includes a lower frustoconical member 21 having a base portion 22 defining a downwardly opening recess 23. The recess is closed across the bottom thereof by a closure plate 24 provided with a discharhge opening 25 aligned with a transfer passage 26 of a connector portion 27 of duct 15 for delivering the ice bodies seriatim into the flowing air in the duct system.

To provide the ice bodies one at a time to the transfer passage, a rotor 48 is provided in recess 23 in overlying relationship to closure plate 24. The rotor may be rotatably driven by a shaft 28 journaled in a suitable carrier 29 and driven by a suitable electric motor 30 through a chain drive 31.

Closure plate 24 may comprise a horizontal upper portion of a support 32 to which motor 30 is mounted by means of a suitable bracket 33 and mounting bolts 34. Lower hopper member 21 is effectively secured to the support 32 by means of suitable bolts, such as bolts 35 and 36, clamping the base 22 of the hopper member 21 to the upper surface of the closure plate 24. As shown in FIG. 2, bolts 36 may extend through the duct portion 27 so as to provide secured relationship between the duct system and the injector valve 17.

The ice bodies in hopper space 19 are agitated by means of an auger-type agitator generally designated 37 having a shaft portion 38 in driven association with rotor shaft 28.

Rotor 48 is secured between an upper hub member 39 and a lower hub member 40 by means of suitable screws 41 whereby the rotor rotates with the auger as a result of rotation of the shaft 28.

The flight 42 of auger 37 causes a gentle tumbling action in the collected ice bodies and concurrently tends to urge the lowermost ice bodies laterally outwardly.

The auger 37 rotates in the clockwise direction in the embodiment of FIG. 2, thus gently lifting the ice cubes from the lower locations and allowing them to fall of their own weight along the outer walls of the hopper 21. Thus rather than forcing the ice cubes downwardly with the auger causing crushing and fusing, the ice cubes will fall of their own weight into the recess and are then gently urged laterally outwardly by the action of the agitator. The integrity of the ice cubes is therefore preserved.

As further shown in FIG. 2, hopper base portion 22 defines an inwardly projecting shelf 43 spaced above the rotor 48 and extending arcuately above the peripheral portion 44 of the rotor.

As shown in FIG. 2, the shelf 43 is spaced above the upper surface of the rotor a distance slightly greater than the average maximum dimension of the ice bodies so that the laterally outwardly urged ice bodies may pass under the shelf into a transfer position in overlying relationship with the peripheral portion 44 of the rotor.

The shelf 43 thus serves the critical function of supporting the weight of the column of ice above the recess 23, thus allowing ice cubes in the recess to move freely, thereby preventing clumping and crushing of ice cubes and preserving their integrity.

Figure 5:
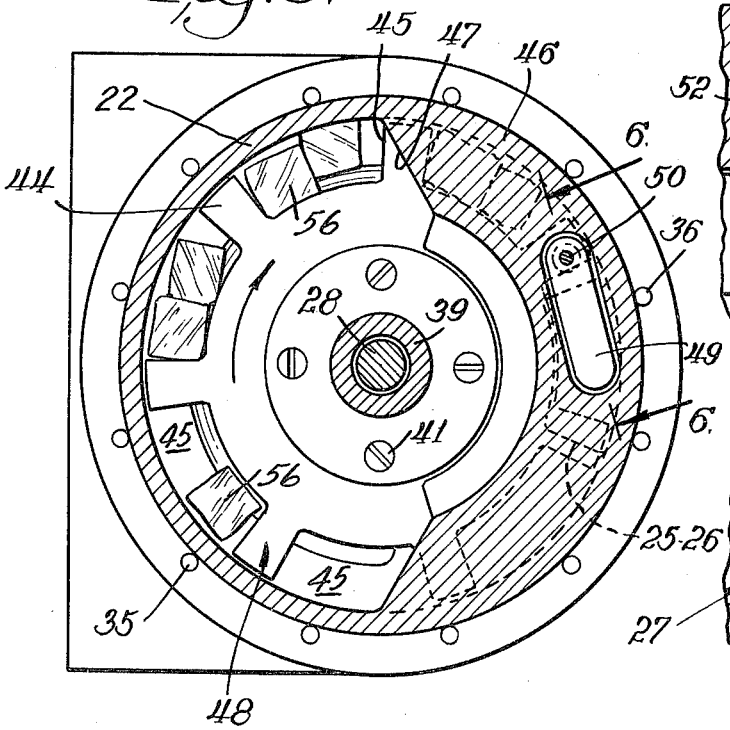
FIG. 5 is a fragmentary horizontal section taken substantially along the line 5—5 of FIG. 2.

Referring now more specifically to FIG. 5, it may be seen that the peripheral portion 44 of the rotor is provided with a plurality of pockets, or recesses 45, adapted to receive the ice bodies passed under shelf 43. As further shown in FIG. 5, hopper base 22 further defines a blocking wall portion 46 extending approximately 180° about the periphery of recess 23. The blocking wall portion defines an angled leading edge surface 47 exposed in the path of any ice bodies resting on the upper surface of the ice bodies in the recesses 45 or on the peripheral portion 44 of the rotor between the recesses 45 so also to deflect the ice bodies radially inwardly back into the mass of ice bodies in the lower portion of the hopper space 19 for subsequent tumbling agitation by the agitator 37 and subsequent delivery into the recesses 45 in the operation of the injector valve.

As shown in FIG. 5, the recesses 45 may have a sufficient arcuate length so as to accommodate a pair of ice bodies therein.

In the illustrated embodiment rotor 48 is rotated by shaft 28 in a clockwise direction, as seen in FIG. 5. When the pockets 45 reach the closure plate opening 25 the ice bodies therein may drop downwardly through the opening 25 and passage 26 into the distribution duct portion 27. To provide positive transfer of the ice bodies from the recesses downwardly into the air duct system, a leaf spring 49 is secured to the hopper portion 22 by suitable means, such as screw 50, so as to be snapped down into the recess 45 when the trailing edge 51 of the leaf spring passes from the peripheral portion 44 of the rotor into overlying relationship to the recess. This snap action forcibly urges the ice body in the recess downwardly to effectively assure desired seriatim delivery of the ice bodies to the distribution system.

Figure 6:
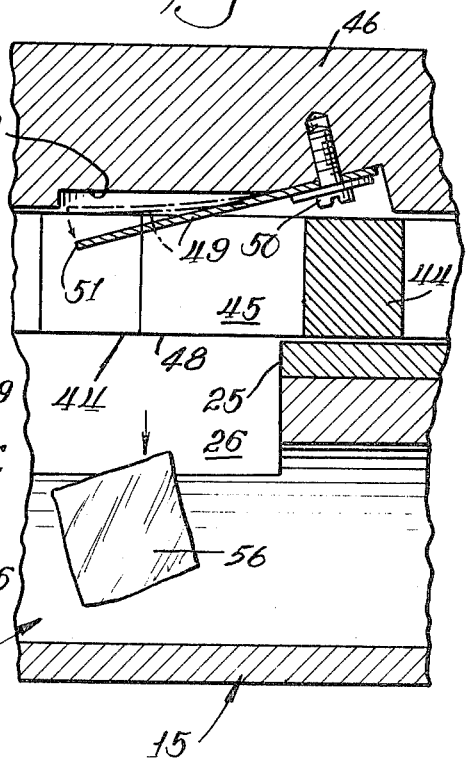
FIG. 6 is a fragmentary enlarged vertical section taken substantially along the line 6—6 of FIG. 5.

As seen in FIG. 6, the spring 49 is biased back into a recess 52 by the rotor portions intermediate the rotor pockets 45.

As best seen in FIG. 2, the rotor 48 has a relatively close fit with the blocking wall portion 46 so as to effectively define an air lock between the distribution system and the storage hopper.

Thus, the present invention comprehends an improved means for delivering seriatim discrete elements from a collecting hopper to a discharge zone where the integrity of the elements is to be preserved, and the elements are of a nature tending to clump or to be sheared or crushed by the action of the rotor. The invention comprehends preventing the overburden elements in the storage hopper space from bearing on the elements delivered to the transfer pockets of the transfer rotor, thereby effectively avoiding such clumping in the transfer operation and allowing free movement of the elements in the recess. The invention is particularly advantageous for use with frangible discrete elements such as ice cubes which tend to be crushed by conventional dispensing apparatus. The invention more specifically comprehends providing a wall structure 43 in preselected relationship to the transfer rotor 48 so as to permit only a single layer of the ice bodies in the illustrated embodiment to pass laterally outwardly into overlying relationship with the transfer pockets of the rotor. The agitator of the hopper mechanism effectively maintains the main body of elements therein in discrete form whereby the cooperative action of the agitator and the clump-preventing shelf provide an improved transfer operation for elements such as ice bodies.

By eliminating the fusion of the ice bodies at the transfer pockets, chipping or flaking of the ice bodies by engagement thereof with wall portions of the transfer device is effectively precluded. Thus, the present invention provides an improved transferring operation wherein the integrity of the transferred ice bodies is effectively maintained avoiding the formation of substantial quantities of slush or ice chips and thereby providing an improved delivery into the air transport system of the desired ice bodies.

Any melt from the ice bodies in the hopper may be removed from the dispensing apparatus by means of a pair of outlet ducts 53 and 54, as shown in FIG. 4. As illustrated therein, closure plate 24 may be provided with an arcuate groove 55 for collecting the melt and delivering it to the discharge duct 54. Duct 53 may open to the central portion of the closure plate adjacent the carrier 29, as shown in FIG. 3, for removing any melt which may be delivered thereto during the operation of the apparatus.

The foregoing disclosure of specific embodiments is illustrative of the broad inventive concepts comprehended by the invention.

The embodiments of the invention in which an exclusive property or privilege is claimed are defined as follows:

1. Dispensing apparatus for dispensing discrete elements such as ice bodies of substantially uniform preselected configuration from a container defining a storage space containing said elements to a discharge position, said container defining a lower portion, said apparatus comprising:

means defining a recess opening generally horizontally to said storage space at said lower portion and having an overlying top wall;

means for guiding the stored elements from said container lower portion generally horizontally into said recess, said recess having a height only slightly greater than the largest dimension of said elements wherein the elements are received therein in a single layer; and transferring means defining an upwardly opening pocket disposed selectively substantially fully subjacent said top wall for receiving elements dropped downwardly from said recess and movable to transfer the received elements to the discharge position.

2. The dispensing apparatus of claim 1 wherein said recess has a height less than twice the greatest transverse dimension of said elements whereby only a single layer of elements is guided into said recess.

3. The dispensing apparatus of claim 1 wherein said lower portion of the container comprises the bottom of said container.

4. The dispensing apparatus of claim 1 wherein said recess has a height less than twice the greatest transverse dimension of said elements whereby only a single layer of elements is guided into said recess and said transferring means defines means for transferring a single height of said elements seriatim to said discharge position.

5. The dispensing apparatus of claim 1 wherein said recess has a horizontal extent toward said container lower portion less than twice the horizontal extent of said elements therein.

6. The dispensing apparatus of claim 1 wherein said elements comprise ice cubes.

7. The dispensing apparatus of claim 1 wherein said means for guiding said elements comprises means for agitating said elements in said storage space.

8. The dispensing apparatus of claim 1 wherein said transferring means comprises a rotor rotatable about a vertical axis for transferring said elements generally horizontally from adjacent said recess to said discharge position.

9. The dispensing apparatus of claim 1 wherein said container defines a hopper having a bottom portion defining said lower portion into which said recess opens.

10. Dispensing apparatus for dispensing seriatim preselected numbers of ice bodies of substantially uniform preselected configuration from a hopper defining a storage space, comprising:

an agitator in a bottom portion of said storage space for effectively precluding fusing together of said ice bodies;

means defining a recess opening substantially horizontally to said storage space bottom portion, said ice bodies being guided by said hopper and agitator generally horizontally into said recess, said recess having a height substantially smaller than that of said storage space and slightly greater than the largest dimension of said elements whereby the ice bodies are received therein in a single layer, said means defining the recess including an overlying shelf preselected to effectively preclude overburden-induced clumping of said ice bodies in the recess; and transfer means-for transferring a preselected number of ice bodies from said recess to a discharge position, said transfer means defining a pocket opening to said recess for receiving said preselected number of ice bodies therefrom as a result of movement of said ice bodies as discrete, separate elements through said recess and into said pocket.

11. The ice body dispensing apparatus of claim 10 wherein said agitator causes a tumbling movement of said ice bodies outwardly from the center of said storage space.

12. The ice body dispensing apparatus of claim 10 wherein said transfer means comprises a rotor having a plurality of pockets therein for receiving seriatim said preselected number of ice bodies and delivering seriatim said received ice bodies to said discharge position.

13. The ice body dispensing apparatus of claim 10 wherein an air transport system is provided having an inlet portion defining said discharge position.

14. The ice body dispensing apparatus of claim 10 wherein said recess means defines a shelf for supporting thereabove a portion of the ice bodies in said storage space.

15. The ice body dispensing apparatus of claim 10 further including means for urging said ice bodies effectively positively from said pocket at said discharge position.

16. In an ice dispensing system for dispensing ice bodies having a preselected configuration serially from a bottom portion of an ice storage hopper, the improvement comprising:

means for guiding ice bodies horizontally in a single layer from said hopper to a recess opening oriented substantially horizontally at a bottom portion of said guiding means and having a height only slightly greater than that of said ice body layer;

a shelf overlying said recess for supporting ice bodies in said guiding means above said recess; and a rotor underlying adjacent said recess for conveying ice bodies from said recess to a discharge position.

17. The method of dispensing a plurality of discrete elements from a hopper wherein the elements are piled loosely, comprising the steps of:

urging a portion of the elements outwardly from a bottom portion of the hopper horizontally in a single layer to a transfer position;

isolating the layer of elements at said transfer position from the piled elements located in the hopper above said transfer position; and transferring said elements from said layer seriatim to a discharge position.

18. The method of dispensing a plurality of discrete elements of claim 17 wherein said transfer position is defined by a space having a horizontal extent only slightly greater than that of an individual element in the direction of said urging.

19. The method of dispensing a plurality of discrete elements of claim 17 wherein said transferring step includes the steps of dropping the elements from the transfer position and translating the elements horizontally subjacent the hopper.

20. The method of dispensing a plurality of discrete elements of claim 17 wherein said urging step comprises a step of agitating the elements in the hopper so as to cause the elements to circulate in a path having a lower portion corresponding to said layer.

* * * * *